US008177231B2

(12) United States Patent
Fukui et al.

(10) Patent No.: US 8,177,231 B2
(45) Date of Patent: May 15, 2012

(54) CONVEYING BODY AND IMAGE FORMING DEVICE

(75) Inventors: Takashi Fukui, Kanagawa (JP); Tatsuya Nitta, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 297 days.

(21) Appl. No.: 12/413,157

(22) Filed: Mar. 27, 2009

(65) Prior Publication Data

US 2009/0243207 A1 Oct. 1, 2009

(30) Foreign Application Priority Data

Mar. 31, 2008 (JP) ..... 2008-091230

(51) Int. Cl.
*B65H 5/18* (2006.01)

(52) U.S. Cl. ..... 271/276; 271/3.22; 271/194; 271/196

(58) Field of Classification Search ..... 271/3.22, 271/276, 194, 196
See application file for complete search history.

(56) References Cited

U.S. PATENT DOCUMENTS 4,145,040 A * 3/1979 Huber ..... 271/276
4,157,178 A * 6/1979 Ollendick ..... 271/276
5,967,510 A * 10/1999 Ono et al. ..... 271/196
6,038,976 A * 3/2000 Helmstadter et al. ..... 101/410
6,074,056 A * 6/2000 Kubo et al. ..... 347/104
6,076,444 A * 6/2000 Okonski ..... 83/99
6,488,194 B1 * 12/2002 Couturier ..... 226/95

FOREIGN PATENT DOCUMENTS

JP 54-65546 A 5/1979
JP 10-244722 A 9/1998
JP 3123853 U 7/2006

* cited by examiner

*Primary Examiner* — Kaitlin Joerger
*Assistant Examiner* — Ernesto Suarez
(74) *Attorney, Agent, or Firm* — Birch, Stewart, Kolasch & Birch, LLP

(57) ABSTRACT

A conveying body that can attract and peel-off a recording medium by a simple mechanism, and an image forming device using the conveying body are provided. One end portions of through-holes of a drum are blocked by a blocking member, and a suction member and a blowing-out member are provided at other end portions of the through-holes. Due to a suction pump being operated and suction force being generated within the through-holes via a suction port of the suction member, the suction force passes through the through-holes and acts on long grooves of an outer peripheral surface of the drum, and a sheet can be attracted reliably to the outer peripheral surface of the drum. Further, because air is blown-out from the blowing-out member by operation of the suction pump, a leading end portion of a sheet can be reliably peeled-off from the outer peripheral surface of the drum.

7 Claims, 9 Drawing Sheets

CONVEYING BODY AND IMAGE FORMING DEVICE

CROSS-REFERENCE TO RELATED APPLICATION

This application claims priority under 35 USC 119 from Japanese Patent Application No. 2008-091230 filed on Mar. 31, 2008, the disclosure of which is incorporated by reference herein.

BACKGROUND

1. Technical Field

The present invention relates to a conveying body that conveys a recording medium, and to an image forming device equipped with the conveying body.

2. Related Art

In cases in which a recording medium is conveyed by plural drums, the recording medium is conveyed in a state of being held at the surface of the cylindrical-tubular drum. Further, when the recording medium is transferred to the next drum, the recording medium must be peeled off from the surface of the drum that is conveying it.

For example, in Japanese Patent Application Laid-Open (JP-A) No. 54-65546, in an electrostatic printing device, blowing-out holes are provided at the surface of a drum, and a blowing-out path is provided within the rotating shaft of the drum. When the leading end of a recording medium comes to a peel-off position, a blowing-out path hole and the blowing-out holes are made to coincide at a bearing portion, and air is blown-out from the drum surface and the recording medium is peeled-off from the drum surface.

Further, in Japanese Utility Model Registration No. 3123853, in a stencil printing device, air is blown by a peeling claw and a separate mechanism at a conveying direction downstream side, in order to peel a sheet off from a drum.

Moreover, in JP-A No. 10-244722, in an inkjet printer, a drum interior is demarcated into plural sections in the rotating direction. Plural holes, that are formed in a fixed, pipe-like drum shaft and that suck and blowing-out air, and holes, that coincide with holes at the inner radial surface of the drum due to rotation, are provided. A recording medium is sucked and held or is peeled-off by switching the rotating direction of a suction/blowing-out fan that is provided at one end portion of the drum shaft.

However, in JP-A No. 54-65546, suction of the recording medium to the drum surface is not carried out only when the recording medium is peeled-off from the drum surface. Further, in Japanese Utility Model Registration No. 3123853, costs are high because a peeling claw and an air blowing mechanism are provided. Moreover, in JP-A No. 10-244722, the rotating direction of a fan must be switched and operation is complex.

SUMMARY

In view of the above-described circumstances, the present invention provides a conveying body that can carry out attracting and peeling of a recording medium by a simple mechanism, and an image forming device using this conveying body.

According to an aspect of the invention, there is provided a conveying body that rotates and conveys a recording medium, the conveying body having: a cylindrical-tubular portion whose outer peripheral surface is a conveying surface for conveying a recording medium; a plurality of groove portions formed in the outer peripheral surface of the cylindrical-tubular portion; a plurality of air paths formed along a peripheral direction at an outer peripheral portion of the cylindrical-tubular portion, respective ones of path openings of the air paths that extend in an axial direction being blocked, and the air paths communicating with the groove portions; a suction member sucking air from others of path openings of the air paths that have rotated and come to a suction position; and a blowing-out member provided adjacent to the suction member, and blowing-out air to others of path openings of the air paths that have come to a blowing-out position.

BRIEF DESCRIPTION OF THE DRAWINGS

An exemplary embodiment of the present invention will be described in detail based on the following figures, wherein.

DETAILED DESCRIPTION

An image forming device, that is equipped with a conveying body relating to an exemplary embodiment of the present invention, is described hereinafter.

First, the overall structure of an image forming device 10 will be described.

(Image Forming Device)

Figure 1:
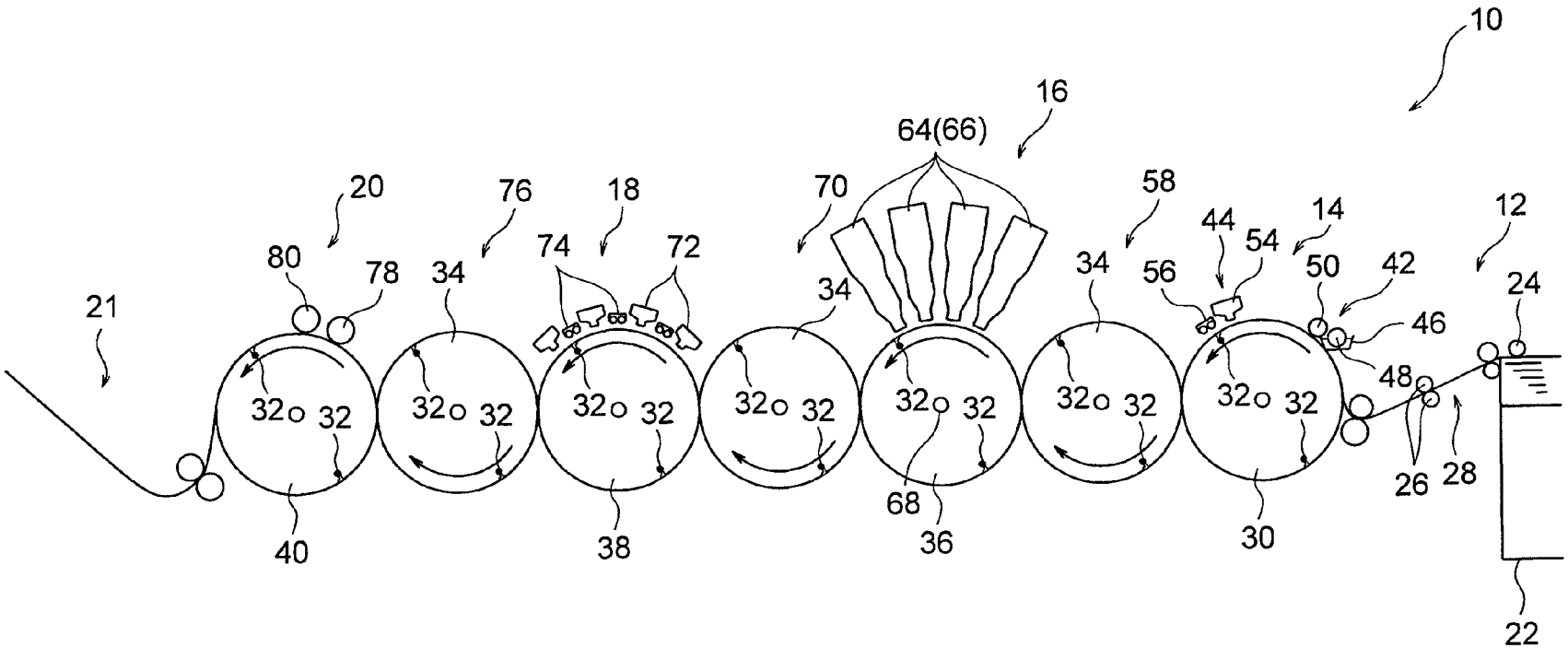
FIG. 1 is an overall structural drawing showing the structure of an image forming device relating to an exemplary embodiment.

As shown in FIG. 1, a feeding/conveying section 12 that feeds and conveys sheets is provided at the image forming device 10 relating to the present exemplary embodiment, at the upstream side in the conveying direction of sheets that serve as recording media. Provided along the sheet conveying direction at the downstream side of the feeding/conveying section 12 are: a processing liquid coating section 14 that coats a processing liquid on a recording surface of the sheet, an image forming section 16 that forms an image on the recording surface of the sheet, an ink drying section 18 that dries the image formed on the recording surface, an image fixing section 20 that fixes the dried image to the sheet, and a discharging section 21 that discharges the sheet on which the image is fixed.

The respective processing sections will be described hereinafter.

(Feeding/Conveying Section)

A stacking section 22 in which sheets are stacked is provided at the feeding/conveying section 12. A sheet feed portion 24, that feeds one-by-one the sheets that are stacked in the stacking section 22, is provided at the downstream side in the sheet conveying direction of the stacking section 22 (there are cases hereinafter in which "in the sheet conveying direction" is omitted) of the stacking section 22. The sheet that is fed by the sheet feed portion 24 is conveyed to the processing liquid coating section 14 via a conveying portion 28 that is structured by plural roller pairs 26.

(Processing Liquid Coating Section)

A processing liquid coating drum 30 is disposed rotatably in the processing liquid coating section 14. Holding members 32, that nip the leading end portions of sheets and hold the sheets, are provided at the processing liquid coating drum 30. In the state in which a sheet is held at the surface of the processing liquid coating drum 30 via the holding member 32, the sheet is conveyed to the downstream side by the rotation of the processing liquid coating drum 30.

In the same way as at the processing liquid coating drum 30, the holding members 32 are provided as well at intermediate conveying drums 34, an image forming drum 36, an ink drying drum 38 and a fixing drum 40 that will be described later. Further, the transfer of a sheet from an upstream side drum to a downstream side drum is carried out by the holding members 32.

A processing liquid coating device 42 and a processing liquid drying device 44 are disposed along the peripheral direction of the processing liquid coating drum 30 at the upper portion of the processing liquid coating drum 30. Processing liquid is coated onto the recording surface of the sheet by the processing liquid coating device 42, and the processing liquid is dried by the processing liquid drying device 44.

The processing liquid reacts with ink, aggregates the color material (pigment), and has the effect of promoting separation of the color material (pigment) and the solvent. A storing portion 46, in which the processing liquid is stored, is provided at the processing liquid coating device 42, and a portion of a gravure roller 48 is soaked in the processing liquid.

A rubber roller 50 is disposed so as to press-contact the gravure roller 48. The rubber roller 50 contacts the recording surface (obverse) side of the sheet such that the processing liquid is coated thereon. Further, a squeegee (not shown) contacts the gravure roller 48 and controls the processing liquid coating amount that is coated on the recording surface of the sheet.

It is ideal that the film thickness of the processing liquid is sufficiently smaller than the droplet ejected by the head. For example, in a case in which the ejected droplet amount is 2 pl, the average diameter of the droplet ejected by the head is 15.6 μm. If the film thickness of the processing liquid is thick, the ink dot floats within the processing liquid without contacting the recording surface of the sheet. It is preferable to make the film thickness of the processing liquid be less than or equal to 3 μm in order to obtain a landed dot diameter of greater than or equal to 30 μm at an ejected droplet amount of 2 pl.

On the other hand, at the processing liquid drying device 44, a hot air nozzle 54 and an infrared heater 56 (hereinafter called "IR heater 56") are disposed near to the surface of the processing liquid coating drum 30. The solvent such as water or the like within the processing liquid is vaporized by the hot air nozzle 54 and the IR heater 56, and a solid or thin-film processing liquid layer is formed on the recording surface side of the sheet. By making the processing liquid be a thin layer in the processing liquid drying process, the dots of ink that are ejected at the image forming section 16 contact the sheet surface such that the necessary dot diameter is obtained, and the actions of reacting with the thin-layer processing liquid, aggregating the pigment, and fixing to the sheet surface are easily obtained.

The sheet, on whose recording surface the processing liquid has been coated and dried at the processing liquid coating section 14 in this way, is conveyed to an intermediate conveying section 58 that is provided between the processing liquid coating section 14 and the image forming section 16.

(Intermediate Conveying Section)

The intermediate conveying drum 34 is provided rotatably in the intermediate conveying section 58. A sheet is held at the surface of the intermediate conveying drum 34 via the holding member 32 provided at the intermediate conveying drum 34, and the sheet is conveyed to the downstream side by the rotation of the intermediate conveying drum 34.

(Image Forming Section)

The image forming drum 36 (that will be described later) is provided rotatably in the image forming section 16. A sheet is held at the surface of the image forming drum 36 via the holding member 32 provided at the image forming drum 36, and the sheet is conveyed to the downstream side by the rotation of the image forming drum 36.

Head units 66, that are structured by single-pass inkjet line heads 64, are disposed at the upper portion of the image forming drum 36 so as to contact the surface of the image forming drum 36. At the head units 66, the inkjet line heads 64 of at least YMCK that are basic colors are arrayed along the peripheral direction of the image forming drum 36, and form images of the respective colors on the processing liquid layer that was formed on the recording surface of the sheet at the processing liquid coating section 14.

The processing liquid has the effect of making the color material (pigment) and the latex particles that are dispersed within the ink aggregate in the processing liquid, and forms aggregates at which flowing of the color material and the like do not arise on the sheet. As an example of the reaction between the ink and the processing liquid, an acid is contained within the processing liquid, and by lowering the pH, pigment dispersion is destroyed, and by using an aggregating mechanism, running of the color material, color mixing between the inks of the respective colors, and ejected droplet interference due to uniting of liquids at the time when the ink drops land are avoided.

The inkjet line heads 64 carry out ejecting of droplets synchronously with an encoder (not illustrated) that is disposed at the image forming drum 36 and detects the rotating speed. Due thereto, the landing positions of the droplets are determined highly accurately, and non-uniform droplet ejection can be reduced independently of deviations of the image forming drum 36, the precision of a rotating shaft 68, or the surface speed of the drum.

Note that the head units 66 can be withdrawn from the upper portion of the image forming drum 36. Maintenance operations such as cleaning of the nozzle surfaces of the inkjet line heads 64, expelling of ink whose viscosity has increased, and the like are carried out by withdrawing the head units 66 from the upper portion of the image forming drum 36.

Due to the rotation of the image forming drum 36, the sheet, on whose recording surface an image is formed, is conveyed to an intermediate conveying section 70 that is provided between the image forming section 16 and the ink drying section 18. Because the structure of the intermediate conveying section 70 is substantially the same as that of the intermediate conveying section 58, description thereof is omitted.

(Ink Drying Section)

The ink drying drum 38 is provided rotatably in the ink drying section 18. Plural hot air nozzles 72 and IR heaters 74 are disposed at the upper portion of the ink drying drum 38 so as to contact the surface of the ink drying section 18.

Here, as an example, the hot air nozzles 72 are disposed at the upstream side and the downstream side, and pairs of IR heaters 74 that are lined-up in parallel are disposed alternately with the hot air nozzles 72. Other than this, numerous IR heaters 74 may be disposed at the upstream side and a large amount of thermal energy irradiated and the temperature of the moisture raised at the upstream side, whereas, at the downstream side, numerous hot air nozzles 72 may be disposed and the saturated water vapor blown-away.

Here, the hot air nozzles 72 are disposed such that the angle at which the hot air is blown out is inclined toward the trailing end side of the sheet. Due thereto, the flow of hot air from the hot air nozzles 72 can be collected in one direction. Further, the sheet can be pushed against the ink drying drum 38 side, and the state in which the sheet is held at the surface of the ink drying drum 38 can be maintained.

Due to the warm air from the hot air nozzles 72 and the IR heaters 74, at the portion of the sheet where the image is formed, the solvent that is dispersed by the color material aggregating action is dried, and a thin-film image layer is formed.

The warm air is usually set to 50° C. to 70° C., although it depends on the conveying speed of the sheet. The evaporated solvent is discharged to the exterior of the image forming device 10 together with air, but the air is recovered. This air may be cooled by a cooler/radiator or the like, and recovered as liquid.

Due to the rotation of the ink drying drum 38, the sheet, on whose recording surface the image is dried, is conveyed to an intermediate conveying section 76 that is provided between the ink drying section 18 and the image fixing section 20. Note that, because the structure of the intermediate conveying section 76 is substantially the same as that of the intermediate conveying section 58, description thereof is omitted.

(Image Fixing Section)

The image fixing drum 40 is provided rotatably in the image fixing section 20. The image fixing section 20 has the function of applying heat and pressure and fusing the latex particles within the image layer that is a thin layer formed on the ink drying drum 38, and fixing them on the sheet.

A heating roller 78 is disposed at the upper portion of the image fixing drum 40 so as to contact the surface of the image fixing drum 40. At the heating roller 78, a halogen lamp is built-in within a metal pipe of aluminum or the like that has good thermal conductivity, and thermal energy of greater than or equal to the Tg temperature of the latex is provided by the heating roller 78. Due thereto, the latex particles fuse and push-in fixing into the indentations and protrusions on the sheet is carried out, and the unevenness of the surface of the image can be leveled and glossiness can be obtained.

A fixing roller 80 is provided at the downstream side of the heating roller 78. The fixing roller 80 is disposed in a state of press-contacting the surface of the image fixing drum 40, and nipping force is obtained between the fixing roller 80 and the image fixing drum 40. Therefore, at least one of the fixing roller 80 and the image fixing drum 40 has an elastic layer at the surface thereof, and has a uniform nip width with respect to the sheet.

The sheet, on whose recording surface an image is fixed by the above-described processes, is conveyed by the rotation of the image fixing drum 40 toward the discharging section 21 side that is provided at the downstream side of the image fixing section 20.

Note that, although the image fixing section 20 is described in the present exemplary embodiment, it suffices to be able to, at the ink drying section 18, dry and fix the image that is formed on the recording surface. Therefore, the image fixing section 20 is not absolutely necessary.

The drum relating to the exemplary embodiment of the present invention will be described next.

As shown in FIG. 1, the processing liquid coating drum 30, the image forming drum 36, the ink drying drum 38 and the fixing drum 40 are used in the processing liquid coating section 14, the image forming section 16, the ink drying section 18 and the image fixing section 20, respectively. However, description will be given of the conveying body relating to the exemplary embodiment of the present invention being applied to the image forming drum 36.

Figure 2:
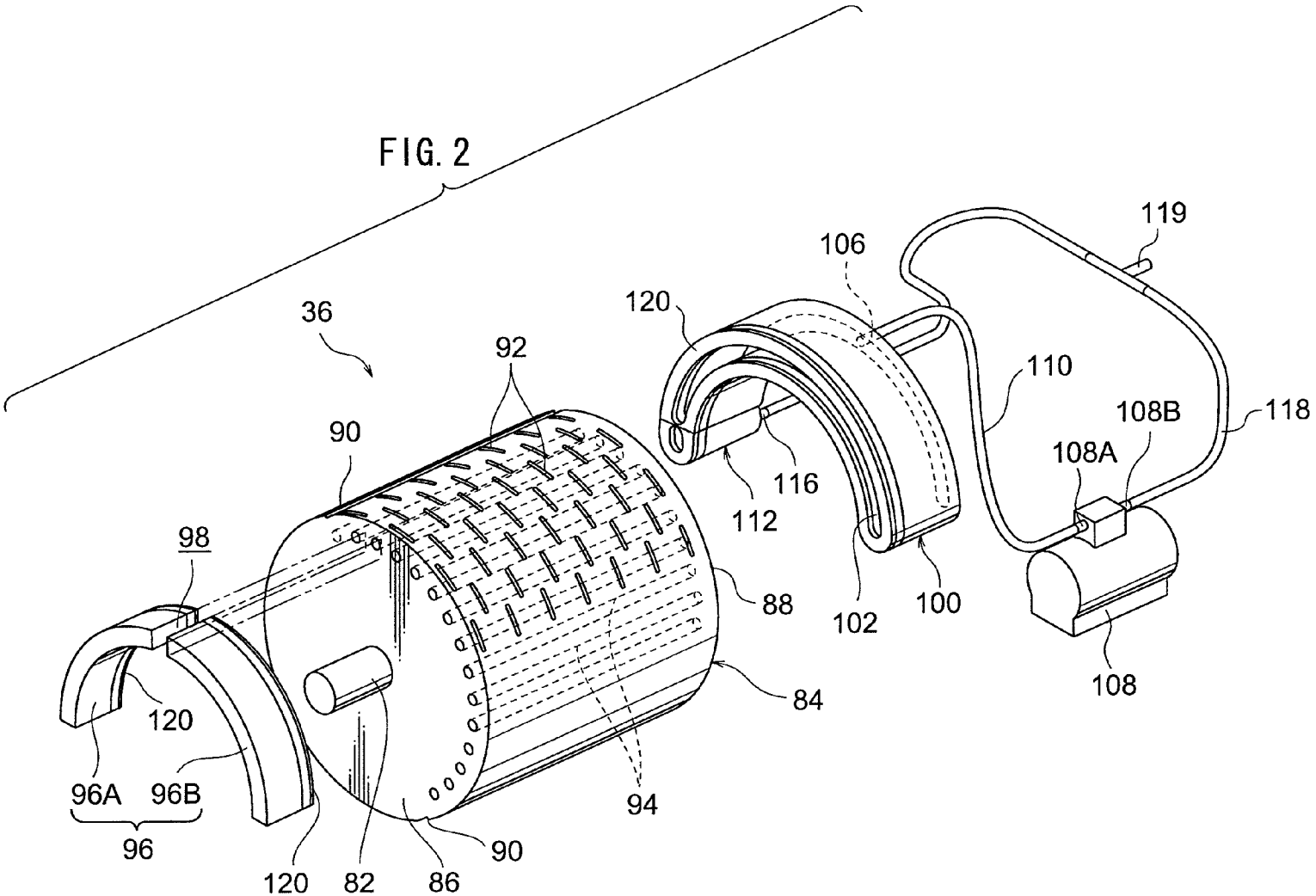
FIG. 2 is an exploded perspective view showing a conveying body relating to a first exemplary embodiment.

As shown in FIG. 2, a rotating shaft 82 is provided at the image forming drum 36. A cylindrical-tubular drum 84 is fixed to the rotating shaft 82. The both end portions of the drum 84 are blocked by discs 86, 88. The rotating shaft 82 passes-through the central portions of the discs 86, 88.

Notch portions 90, that form substantially triangular shapes as seen in side view, are formed in the outer peripheral surface of the drum 84 along the axial direction of the drum 84 at intervals of 180°. Due to the leading end portion of the sheet that is being conveyed abutting the notch portion 90, movement of the sheet is restricted, and the sheet is positioned on the drum 84.

Figure 3:
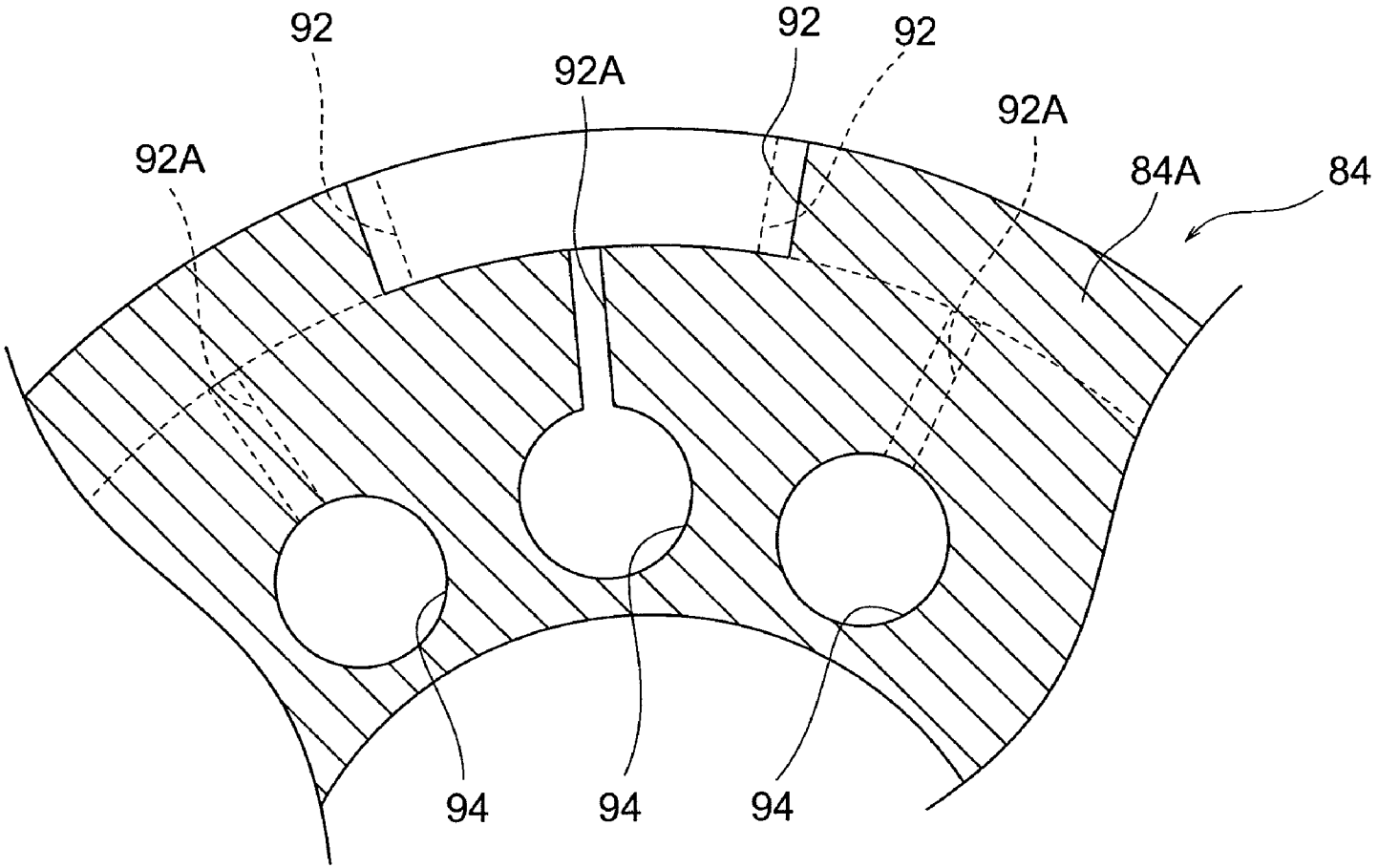
FIG. 3 is a cross-sectional view showing long grooves and through-holes of the conveying body relating to the first exemplary embodiment.

Plural long grooves 92, that extend along the peripheral direction of the drum 84, are formed in the outer peripheral surface of the drum 84 along the axial direction of the drum 84. As shown in FIG. 3, a round hole 92A is formed in the central portion of the long groove 92 (as will be described later). Further, the long grooves 92 are disposed alternately in the peripheral direction of the drum 84. End portions of the long grooves 92 that are adjacent to one another in the peripheral direction overlap one another in the axial direction.

Through-holes (air paths) 94 that are substantially cylindrical pass-through a peripheral wall (outer peripheral portion) 84A of the drum 84. The aforementioned round holes 92A are provided along the radial direction of the drum 84 from the through-holes 94, and the through-holes 94 communicate with the long grooves 92 via the round holes 92A.

On the other hand, as shown in FIG. 2, a blocking member 96 abuts the disc 86 that is positioned at one end portion of the drum 84. The outer diameter of the blocking member 96 is substantially the same as that of the disc 86, and the blocking member 96 forms an arc shape of approximately 180° along the peripheral direction of the disc 86. The blocking member 96 abuts the peripheral portions of respective one end portions of the plural through-holes 94 that pass-through the disc 86 (respective ones of the path openings of the air paths), so as to block these through-holes 94.

Here, the blocking member 96 is fixed to an unillustrated holding stand. Further, the blocking member 96 is separated into two portions. An interval corresponding to one of the through-holes 94 is provided between blocking member 96A and blocking member 96B, such that a region that does not block the through-hole 94 is provided. This region is an open portion (opening) 98 that opens one end portion of the through-hole 94.

Figure 4:
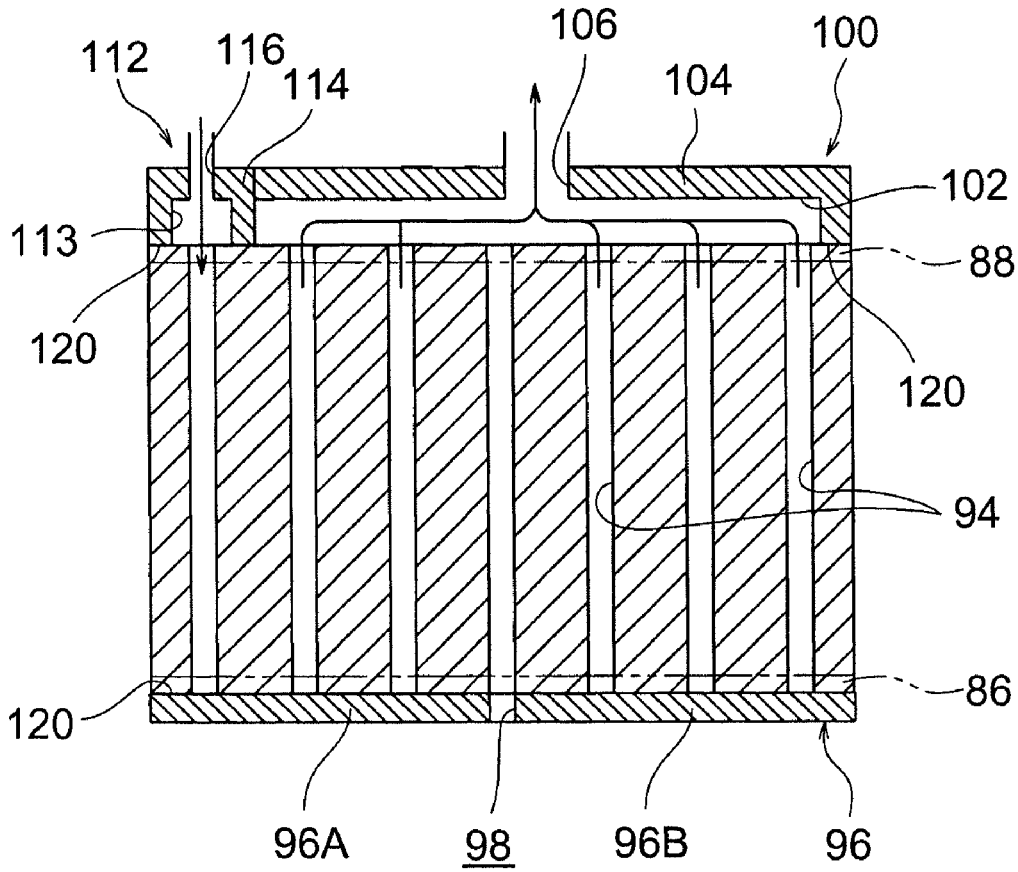
FIG. 4 is a cross-sectional view showing, along the peripheral direction, the conveying body relating to the first exemplary embodiment.

Moreover, a suction member 100 abuts the disc 88 that is positioned at the other end portion of the drum 84. The outer diameter of the suction member 100 is substantially the same as that of the disc 88, and the suction member 100 forms an arc shape of approximately 180° along the peripheral direction of the disc 88. The suction member 100 can face the respective other end portions of the plural through-holes 94 that pass-through the disc 88 (respective other path openings of the air paths). As shown in FIG. 2 and FIG. 4, the portion of the suction member 100 that faces the through-holes 94 is a recess 102. The plural through-holes 94 communicate with one another by this recess 102.

The suction member 100 is fixed to an unillustrated holding stand. A suction port 106 is formed in a ceiling portion 104 of the suction member 100. The suction port 106 and the through-holes 94 communicate with one another. Further, a suction hose 110, that is connected to a suction port 108A of a suction pump 108, is connected to the suction port 106.

A blowing-out member 112, that can face one or two of the through-holes 94, is provided at one end of the suction member 100 along the peripheral direction thereof (the upstream side in the direction of rotation of the drum 84). As shown in FIG. 4, the blowing-out member 112 abuts the disc 88 of the drum 84, and can face the through-holes 94.

As shown in FIG. 2 and FIG. 4, the portion of the blowing-out member 112, which portion faces the through-holes 94, is a recess 113. One or two of the through-holes 94 can be made to communicate with one another by the recess 113. Further, a blowing-out port 116 is formed in a ceiling portion 114 of the blowing-out member 112, and the blowing-out port 116 and the through-holes 94 communicate with one another.

A blowing-out hose 118, that is connected to a blowing-out port 108B of the suction pump 108, is connected to the blowing-out port 116. Due thereto, the air, that is sucked at the suction pump 108 via the suction member 100 and the suction hose 110, is blown-out from the blowing-out member 112 via the blowing-out hose 118.

Here, an exhaust pipe 119 is connected to the blowing-out hose 118. The amount of the air that is sent to the blowing-out member 112 is adjusted by an unillustrated valve that is provided at the exhaust pipe 119. Note that, here, the suction member 100 and the blowing-out member 112 are provided separately, and are made to be integral in a state of being adjacent to one another. However, a single member may be partitioned into two and divided into a suction portion and a blowing-out portion.

On the other hand, the abutment surfaces 120, at which the blocking member 96, the suction member 100 and the blowing-out member 112 abut the discs 86, 88, are formed using a flexible member such as a rubber member or the like, and are coated with a fluorine-based coating.

Namely, elasticity is provided by forming the abutment surfaces 120 by rubber members. The tight fit between, on the one hand, the abutment surfaces 120 of the blocking member 96, the suction member 100 and the blowing-out member 112, and, on the other hand, the discs 86, 88 is improved, and the air-tightness can be improved.

Further, by providing a fluorine-based coating at the surfaces of the abutment surfaces 120, the slidability improves. Because the drum 84 rotates relatively with respect to the blocking member 96, the suction member 100 and the blowing-out member 112, the load placed on the rotating shaft 82 can be reduced by improving the slidability between, on the one hand, the abutment surfaces 120 of the blocking member 96, the suction member 100 and the blowing-out member 112, and, on the other hand, the discs 86, 88.

Note that the suction force in the peripheral direction of the drum 84 can be changed by changing the force of the tight fit between the abutment surfaces 120 and the discs 86, 88 in the peripheral direction of the drum 84.

In the present exemplary embodiment, respective one end portions of the through-holes 94 of the drum 84 are blocked by the blocking member 96, and the suction member 100 is provided at the other end portions of the through-holes 94. The suction member 100 communicates with the plural through-holes 94, and sucks the air that is within the through-holes 94. However, because one end portions of the through-holes 94 are blocked, the suction force acts on the outer peripheral surface of the drum 84 via the long grooves 92 that communicate with these through-holes 94.

Figure 5:
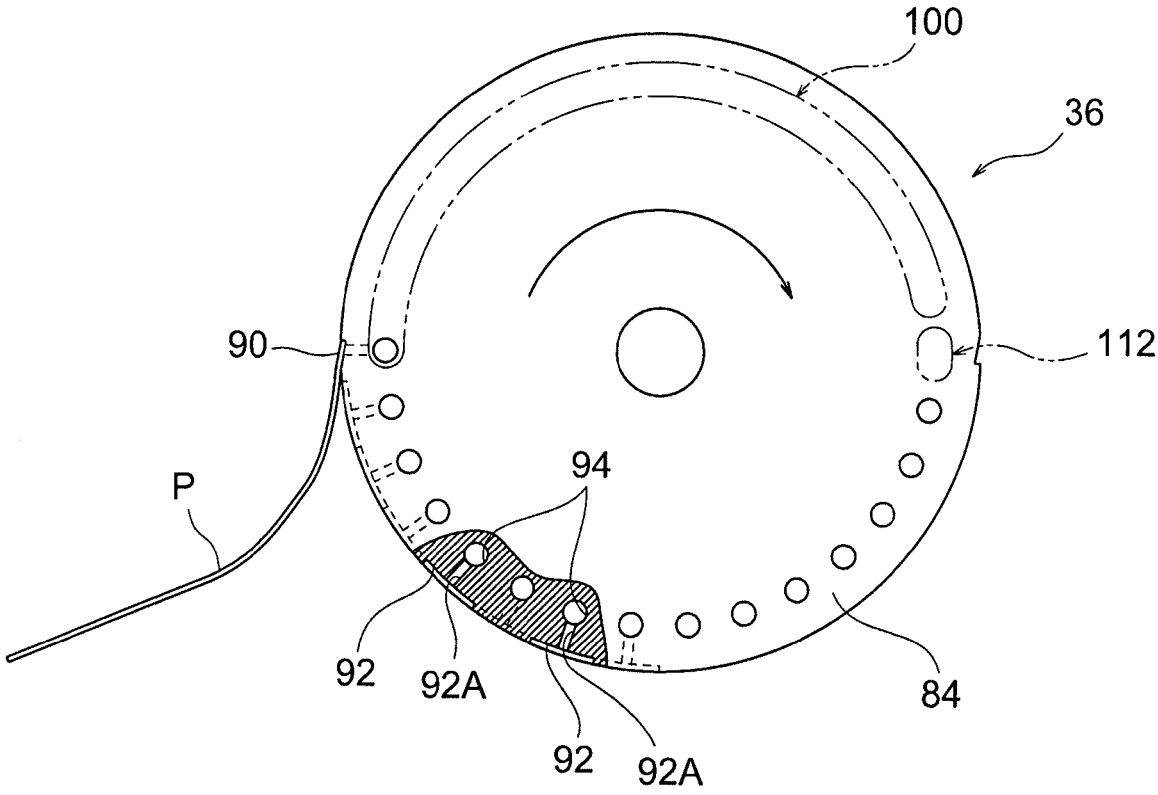
FIG. 5 is a side view explaining operation of the conveying body relating to the first exemplary embodiment.

As shown in FIG. 5, conveying of a sheet P starts due to the leading end portion of the sheet P abutting and being positioned by the notch portion 90 that is formed in the outer peripheral surface of the drum 84. At this time, by operating the suction pump 108 shown in FIG. 2 and generating suction force within the through-holes 94 via the suction port 106 of the suction member 100, the suction force passes through these through-holes 94 and acts on the long grooves 92 of the outer peripheral surface of the drum 84. Therefore, the sheet P, that is conveyed at the outer peripheral surface of the drum 84, can be attracted to the outer peripheral surface of the drum 84.

Here, round holes 91 (see FIG. 9) are formed in the notch portions 90 along the axial direction of the drum 84 at intervals that are more narrow than the long grooves 92. Due thereto, the suction force thereat is higher than at other regions, and the sheet P is reliably attracted to the outer peripheral surface of the drum 84. Further, at the notch portions 90, holes that connect with the through-holes 94 are not formed in the disc 86, and respective one end portions of the through-holes 94 are in a state of being blocked (as will be described later).

The blowing-out member 112 is provided at the other end portions of the through-holes 94, adjacent to the suction member 100. The blowing-out member 112 communicates with the through-holes 94, and blows-out air into these through-holes 94. Because one end portions of the through-holes 94 are blocked, due to air being blown-out into the through-holes 94 by the blowing-out member 112, the blowing-out force acts on the outer peripheral surface of the drum 84 via the long grooves 92 that communicate with these through-holes 94.

Figure 6:
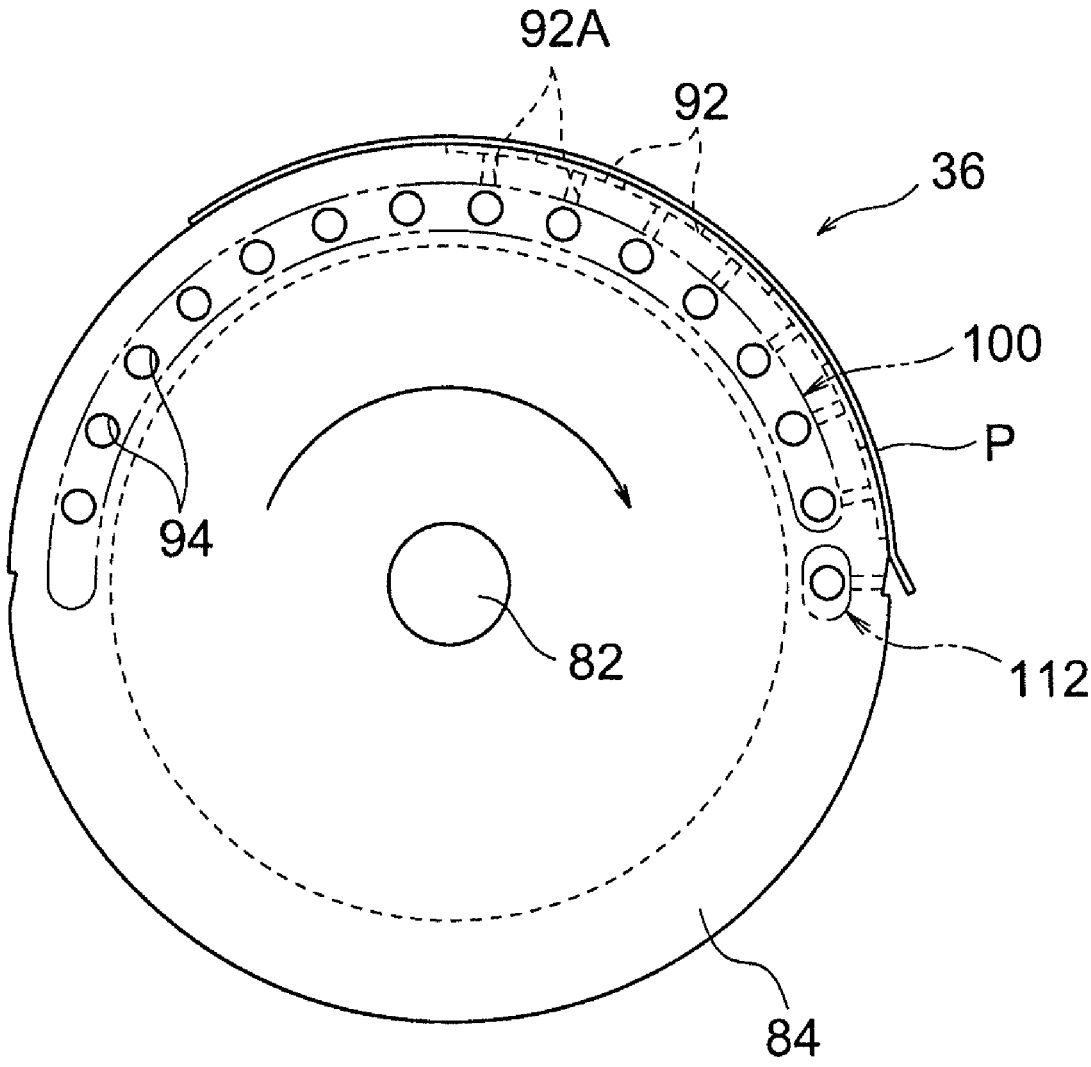
FIG. 6 is a side view explaining operation of the conveying body relating to the first exemplary embodiment.

Air is blown-out from the blowing-out port 116 of the blowing-out member 112 due to the operation of the suction pump 108. As shown in FIG. 6, when conveying of the sheet P is finished, the through-holes 94 that are positioned at the leading end portion of the sheet P face the blowing-out member 112.

Due thereto, the blowing-out force of the blowing-out member 112 passes through these through-holes 94 and acts on the long grooves 92 of the outer peripheral surface of the drum 84. Therefore, the leading end portion of the sheet P floats-up from the outer peripheral surface of the drum 84, and the sheet P can reliably be peeled-off from the outer peripheral surface. Then, the sheet P, that is peeled-off from the outer peripheral surface of the drum 84, is transferred to the unit at the downstream side in the conveying direction (here, the intermediate conveying drum 34 shown in FIG. 1).

By using the suction member 100 and the blowing-out member 112 in this way, suction force is generated at the suction member 100 (suction process), and blowing-out force is generated at the blowing-out member 112 (blowing-out process). Due thereto, suction force or blowing-out force is applied to the through-holes 94 that reach the position corresponding to the suction member 100 or the blowing-out member 112.

Namely, due to the drum 84 rotating, the through-holes 94 successively switch from the suction process to the blowing-out process. Therefore, switching the rotating direction or the like such as at a fan or the like is not needed, and the attracting and peeling-off of the sheet P can be carried out by a simple mechanism.

Further, by carrying out suction of air by the suction member 100 in order from the leading end portion to the trailing end portion of the sheet P due to the rotation of the drum 84, the sheet P is sucked to the outer peripheral surface of the drum 84 in order from the leading end portion to the trailing end portion of the sheet P. By sucking the sheet to the outer peripheral surface of the drum 84 in order from the leading end portion to the trailing end portion of the sheet P in this way, twisting, wrinkling and the like can be made to not occur at the sheet P.

Further, by carrying out blowing-out of air by the blowing-out member in order from the leading end portion to the trailing end portion of the sheet P due to the rotation of the drum 84, the sheet P can be peeled-off from the outer peripheral surface of the drum 84 in order from the leading end portion to the trailing end portion of the sheet P. When the sheet P is transferred to the downstream side in the conveying direction of the sheet P, because the sheet P is sucked to the outer peripheral surface of the drum 84 in order from the leading end portion to the trailing end portion, the sheet P is peeled-off in order from the leading end portion to the trailing end portion of the sheet P at the conveying direction upstream side drum.

Further, as shown in FIG. 2, the suction pump 108 is provided between the suction member 100 and the blowing-out member 112. Due to the air, that is sucked at the suction member 100 via the suction pump 108, being blown-out at the blowing-out member 112, suction and blowing-out are possible with a single wind power generating source and, furthermore, without switching the wind power generating source. Moreover, as compared with a case using plural wind power generating sources, costs can be reduced.

Due to the rotation of the drum 84, all of the long grooves 92 that are provided in the surface of the drum 84 pass by the blowing-out region of the blowing-out member 112. Therefore, even if negative pressure remains within the long grooves 92 at the time of passing-by the suction region of the suction member 100, air is blown-out from the long grooves 92 at the blowing-out region. Accordingly, there is no need to remove the negative pressure, and the sheet P can bee peeled-off reliably from the surface of the drum 84.

By providing the suction member 100 and the blowing-out member 112 at the exterior of the drum 84, a flow path structure (machining of the rotating shaft, laying of pipes within the cylindrical-tubular portion, and the like) for ensuring a flow path of the air is not needed and costs can be reduced, as compared with a case in which the suction member 100 and the blowing-out member 112 are provided at the interior of the drum 84.

Further, because the peeling-off of the sheet P by the blowing-out member 112 is carried out instantaneously only at the peel-off position, the suction pump 108 can be made to be compact as compared with a case in which the entire sheet P is peeled-off. Moreover, the flow paths from the through-holes 94, that generate the suction force or the blowing-out force at the outer peripheral surface of the drum 84, to the suction pump 108 are simple. Therefore, the pressure loss of the suction pump 108 can be reduced, and adjusting of the air amount can be simplified.

As show in FIG. 2 and FIG. 4, the open portion 98, that opens one end portion of the through-hole 94, is provided at the blocking member 96 between the blocking member 96A and the blocking member 96B. At recording position A by the inkjet line heads 64, the sheet must be prevented from becoming concave along the shapes of the long grooves 92 due to the suction force.

Figure 7:
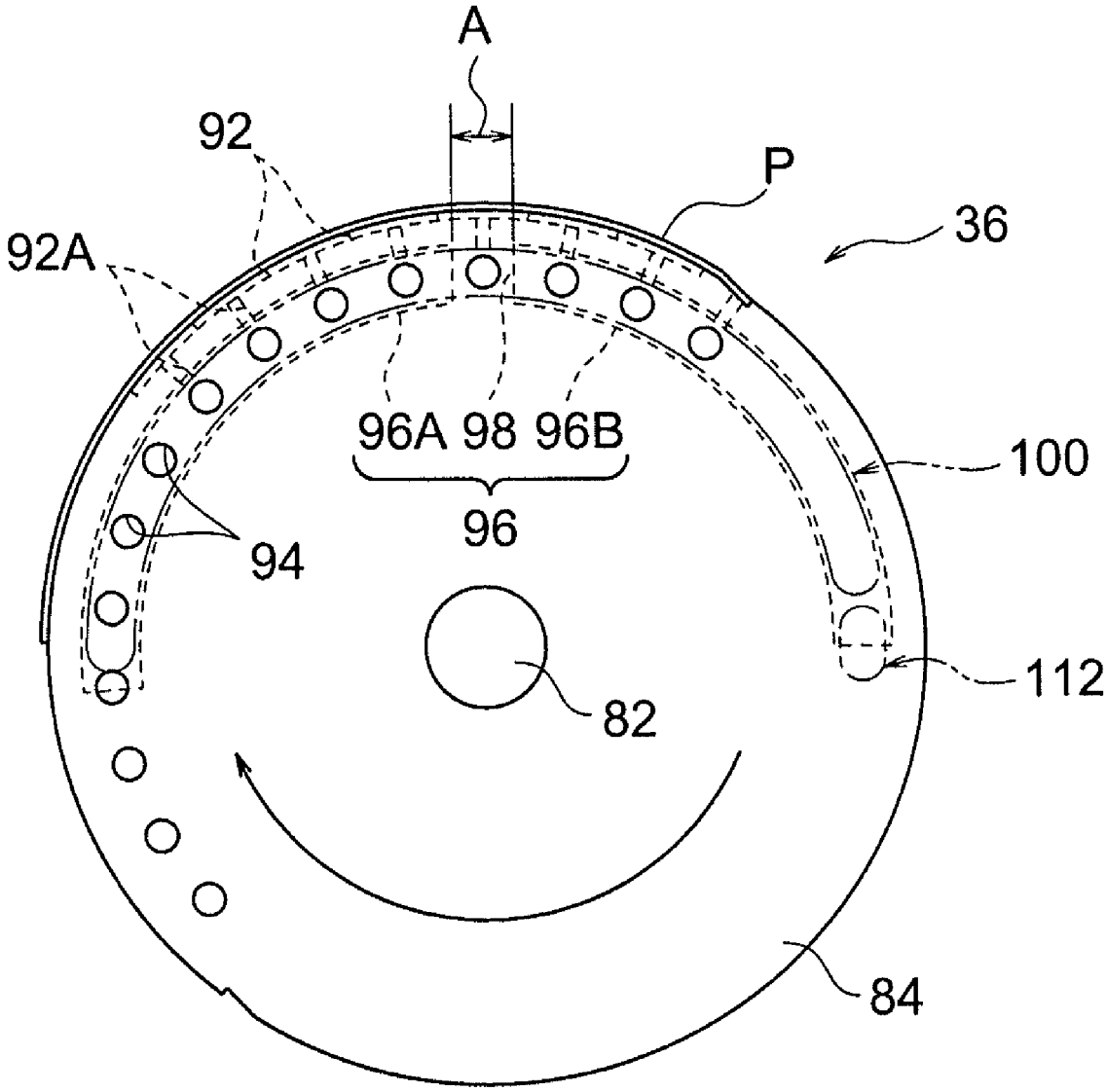
FIG. 7 is a side view explaining operation of the conveying body relating to the first exemplary embodiment.

Therefore, as shown in FIG. 7, the through-hole 94 that is positioned at this recording position A communicates with the open portion 98, and the suction force of the long grooves 92 that communicate with this through-hole 94 is cancelled or reduced. Due thereto, at the recording position A, indentations and protrusions of the surface of the sheet P can be eliminated, and the image quality can be improved.

Here, as described above, at the notch portions 90, holes that connect with the through-holes 94 are not formed in the disc 86, and one end portions of the through-holes 94 are in a state of being blocked.

By providing the open portion 98 at the blocking member 96, when the notch portion 90 reaches the open portion 98 due to the rotation of the drum 84, the suction force of the long grooves 92 that communicate with the through-hole 94 is cancelled, and the leading end portion of the sheet P that is being conveyed is in a state of not being attracted to the outer peripheral surface of the drum 84.

Therefore, in order to overcome this drawback, one end portions of the through-holes 94 are always blocked at the notch portions 90. Due thereto, at the notch portions 90, one end portions of the through-holes 94 are not open, regardless of the positions of the notch portions 90 and the open portion 98 that is provided in the blocking member 96.

Note that, in the present exemplary embodiment, although the long grooves 92 and the through-holes 94 are formed over one-half of the periphery of the drum 84 as shown in FIG. 2, the long grooves 92 and the through-holes 94 may be formed over the entire periphery. Further, suction and blowing-out may be carried out plural times by the suction member 100 and the blowing-out member 112 during the time that the drum 84 rotates one time.

As shown in FIG. 3, the through-holes 94 and the long grooves 92 are made to communicate via the round holes 92A. However, the through-holes 94 and the long grooves 92 may be made to communicate directly. Further, because it suffices for the long grooves 92 to be able to communicate with the through-holes 94, the shapes thereof are not particularly prescribed. However, smaller is better in consideration of the effects on the sheet (the surface caving-in at places corresponding to the long grooves 92).

Figure 8:
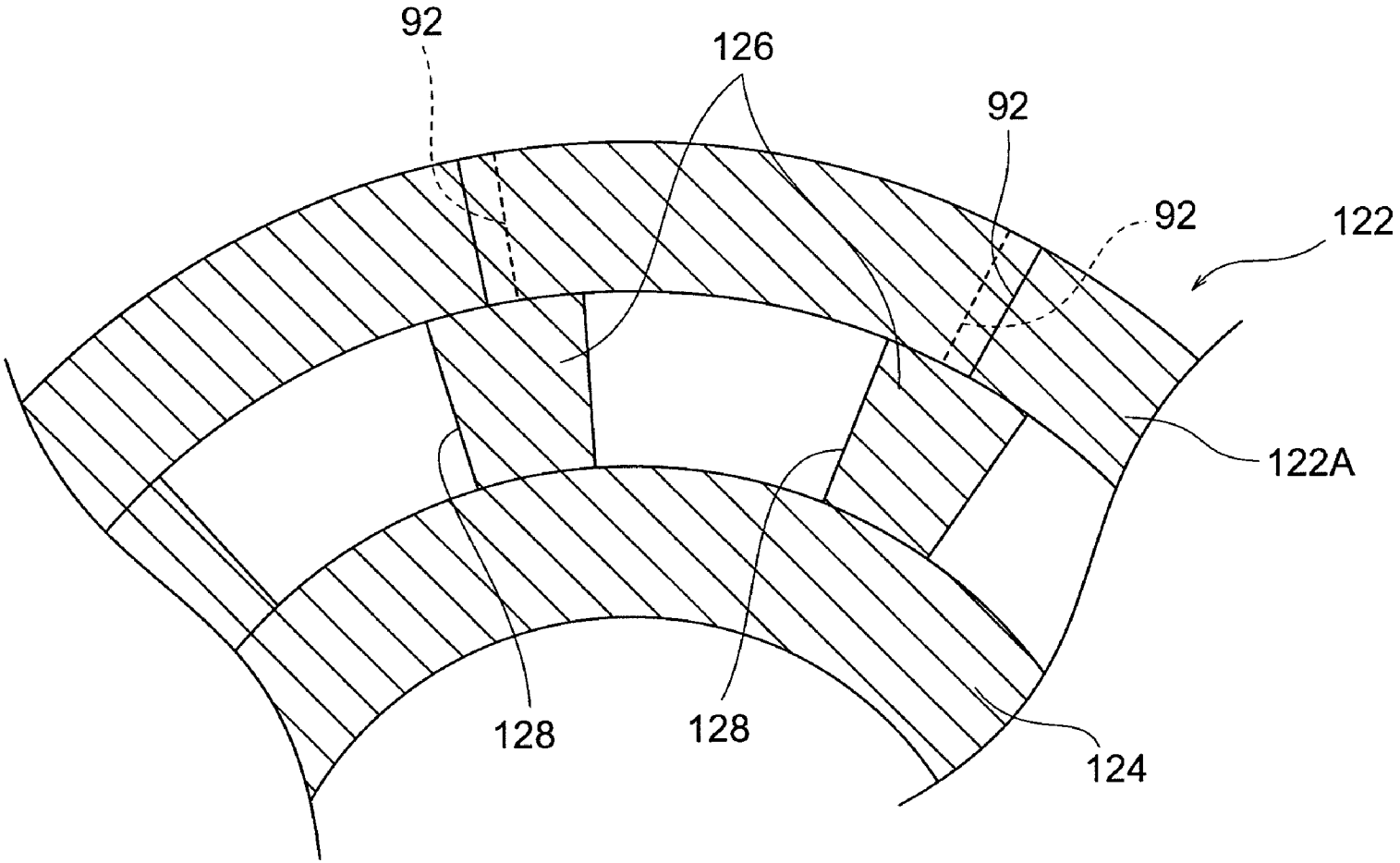
FIG. 8 is a cross-sectional view showing a modified example of the long grooves and the through-holes of the conveying body relating to the first exemplary embodiment.

Moreover, here, the long grooves 92, the round holes 92A and the through-holes 94 are formed in the peripheral wall 84A of the drum 84. However, it suffices for the through-holes 94 to be air paths that are formed along the axial direction of the drum 84. Accordingly, as shown in FIG. 8 for example, an annular wall 124 may be provided at the inner side of a peripheral wall 122A of a drum 122, and the peripheral wall 122A and the annular wall 124 may be connected by plural ribs 126, and air paths 128 may be formed between the rib 126 and the rib 126.

Still further, in the present exemplary embodiment, as shown in FIG. 2, both end portions of the through-holes 94 are provided at the end surfaces of the peripheral wall 84A of the drum 84, and the blocking member 96 is made to abut one end surface of the drum 84, and the suction member 100 and the blowing-out member 112 are made to abut the other end surface of the drum 84. However, because it suffices to be able to carry out suction and blowing-out of the air of the through-holes 94 within the drum 84, the structure is not limited to this.

Figure 9:
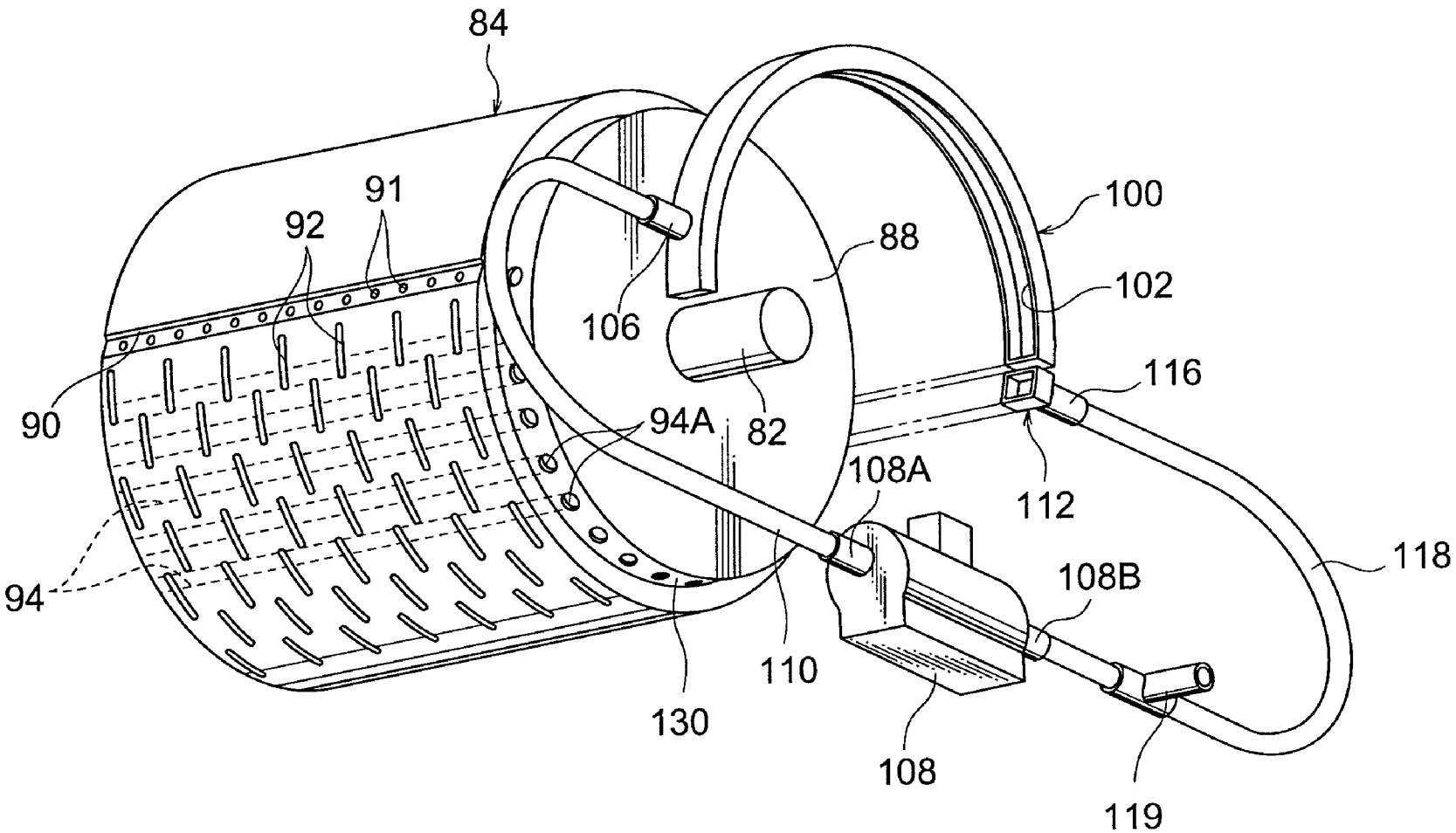
FIG. 9 is an exploded perspective view showing a modified example of the conveying body relating to the first exemplary embodiment.

For example, as shown in FIG. 9, the through-holes 94 are provided in one end surface of the peripheral wall 84A of the drum 84, and the other end portions of the through-holes 94 are provided at the outer peripheral surface of the other end portion of the peripheral wall 84A. In this case, at the other end portion of the drum 84, a small diameter portion 130 is formed, and openings 94A are provided in the radial direction of the substantially cylindrical through-holes 94, and the through-holes 94 can thereby be made to pass-through in a same rectilinear form.

Further, the suction member 100 and the blowing-out member 112, that are formed in arc shapes in accordance with the outer shape of the small diameter portion 130, are fit-in from the outer side of the small diameter portion 130, so as to attach the suction member 100 and the blowing-out member 112.

Due thereto, the present exemplary embodiment can be applied even to cases in which the suction member 100 and the blowing-out member 112 cannot be disposed at the end surface of the drum 84, or the like, due to constraints on the space for placement of the drum 84 or the like.

Note that description relating to the image forming drum 36 is given in the above exemplary embodiment. However, in accordance with the present invention, a sheet can be reliably sucked and peeled-off in a drum shape, and therefore, the present invention may be applied to other drums. However, at other drums, the open portion 98 that is provided in the blocking member 96 is not necessary. Further, in this case, there is no need for the one end portions of the through-holes 94 to pass-through the disc 86, and the blocking member 96 is not necessary.

The above exemplary embodiment describes an image forming device that expels ink and forms an image on a sheet, but the liquid that is expelled is not limited to ink. For example, the present invention can be applied to drying devices in general having various industrial applications as the objects thereof, such as the formation of bumps for parts mounting that is carried out by ejecting solder in a molten state onto a substrate, the formation of an EL display panel that is carried out by ejecting an organic EL solution onto a substrate, or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with various modifications as are suited to the particular use contemplated. It is intended that the scope of the invention be defined by the following claims and their equivalents.

What is claimed is:

1. An image forming device comprising:

a recording head expelling droplets toward a recording medium; and a conveying body that rotates, faces the recording head and conveys a recording medium, the conveying body comprising:

a cylindrical-tubular portion whose outer peripheral surface is a conveying surface for conveying the recording medium;

a plurality of groove portions formed in the outer peripheral surface of the cylindrical-tubular portion;

a plurality of air paths communicating with the groove portions and formed along a peripheral direction of the cylindrical-tubular portion, the air paths extending in an axial direction of the cylindrical-tubular portion and including first path openings and second path openings;

wherein the first path openings are provided at a first end surface of the cylindrical-tubular portion, and the second path openings are provided at an opposite second end surface of the cylindrical-tubular portion, wherein the first path openings of the air paths are blocked by a blocking member that contacts the first end surface of the cylindrical-tubular portion, wherein the blocking member includes an open region that opens one path of the air paths at a position of recording by the recording head, the conveying body further comprising:

a suction member sucking air from second path openings of the air paths that have rotated and come to a suction position; and a blowing-out member provided adjacent to the suction member, and blowing-out air to the second path openings of the air paths that have come to a blowing-out position, wherein the first openings of the air paths are blocked by a blocking member that contacts an end surface of the cylindrical-tubular portion, wherein a suction port of the suction member is formed in a shape of an arc along the peripheral direction of the cylindrical-tubular portion, and a blowing-out port of the blowing-out member is provided at an end portion of the suction port or provided separately, wherein second path openings of the air paths, that are positioned at a leading end portion of the recording medium when conveying of the recording medium starts, communicate with the suction port of the suction member, and second openings of the air paths, that are positioned at a trailing end portion of the recording medium when conveying of the recording medium ends, communicate with the blowing-out port of the blowing-out member.

2. The image forming device of claim 1, wherein the suction member and the blowing-out member are connected at a suction pump, and air that is sucked by the suction member via the suction pump is blown-out by the blowing-out member.

3. The image forming device of claim 1, wherein a positioning portion, that restricts movement of a leading end portion of the recording medium and determines a position of the leading end portion, is provided at the outer peripheral surface of the cylindrical-tubular portion the positioning portion including notch portions that are formed in the outer peripheral surface of the cylindrical-tubular portion along the axial direction of the cylindrical-tubular portion.

4. The image forming device of claim 1, wherein a sliding member that is flexible is provided at an abutting surface at which the cylindrical-tubular portion, and the suction member and the blowing-out member, abut.

5. The image forming device of claim 1, wherein suction of air by the suction member is carried out in order from a leading end portion to a trailing end portion of the recording medium due to rotation of the cylindrical-tubular portion.

6. The image forming device of claim 1, wherein blowing-out of air by the blowing-out member is carried out in order from a leading end portion to a trailing end portion of the recording medium due to rotation of the cylindrical-tubular portion.

7. The image forming device of claim 1, wherein, in conjunction with rotation of the cylindrical-tubular portion, the air paths switch from a suction process in which the recording medium is sucked to the outer peripheral surface of the cylindrical-tubular portion, to a peeling process in which the recording medium is peeled-off from the outer peripheral surface of the cylindrical-tubular portion.

* * * * *